United States Patent [19]

Caldwell

[11] 4,201,433

[45] May 6, 1980

[54] GROUNDING CONNECTOR

[75] Inventor: Dan H. Caldwell, Red Bank, N.J.

[73] Assignee: Fargo Manufacturing Company, Inc., Poughkeepsie, N.Y.

[21] Appl. No.: 922,286

[22] Filed: Jul. 6, 1978

[51] Int. Cl.[2] ..... H01R 3/06

[52] U.S. Cl. ..... 339/14 L; 339/22 R; 269/257

[58] Field of Search ..... 339/14 L, 14 R, 17 M, 339/22 R, 95; 269/257

[56] References Cited

U.S. PATENT DOCUMENTS 4,005,921 2/1977 Hadden et al. ..... 339/14 R

*Primary Examiner*—Roy Lake

*Assistant Examiner*—DeWalden W. Jones

[57] ABSTRACT

A grounding connector including a base plate having a plurality of grooves for aluminum clad or other similar metal clad telephone cables and a pressure pad adapted to be removably coupled with the base plate to facilitate retention of the metal clad telephone cables in the grooves. The connector is adapted to be connected to ground. Each groove has a configuration for assisting and retaining the metal clad telephone cables therein and grounding the cable.

12 Claims, 10 Drawing Figures

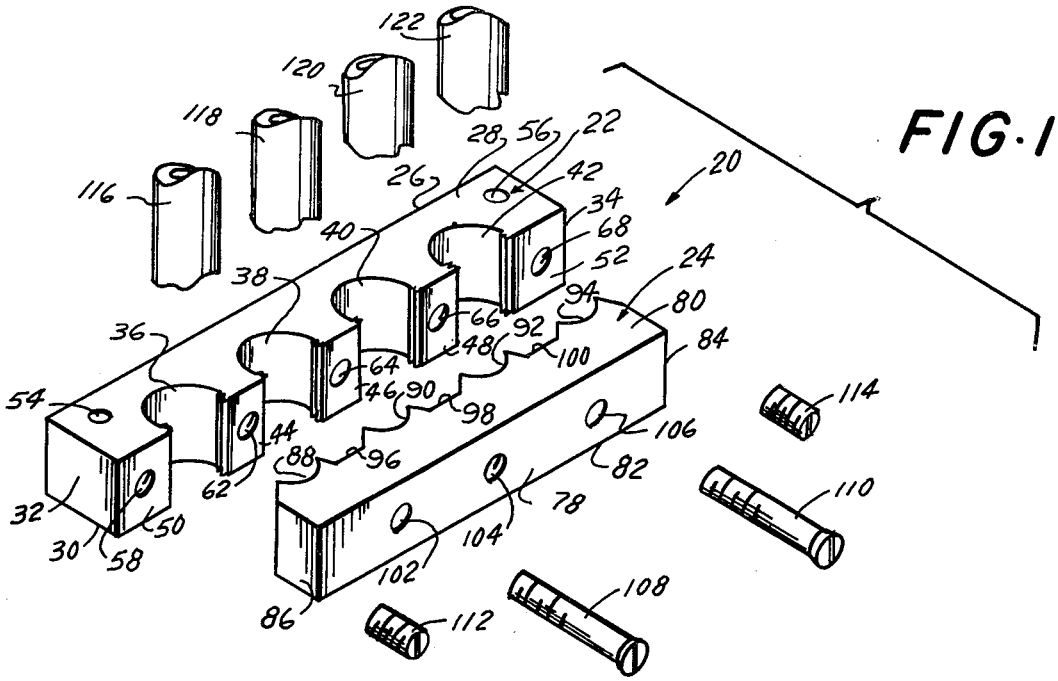
FIG. 1
FIG. 2
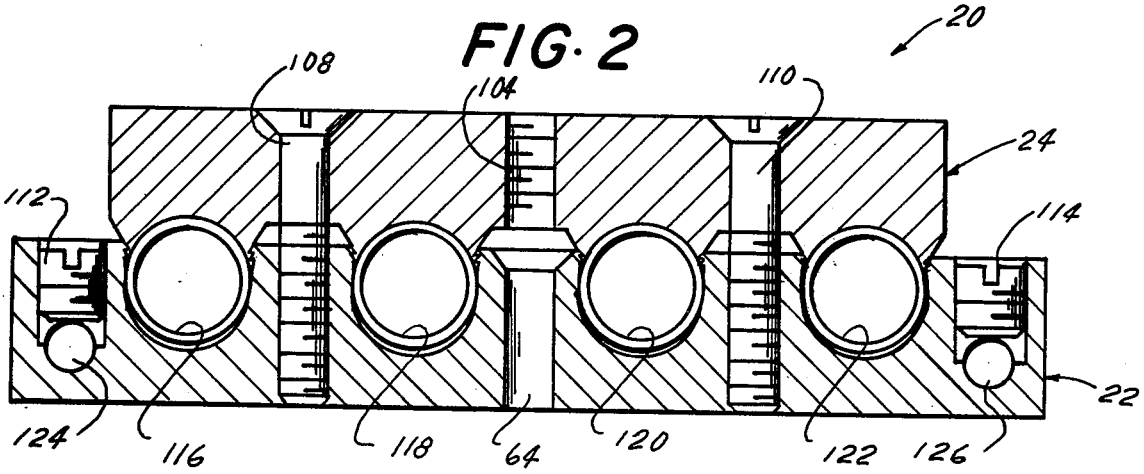
FIG. 3
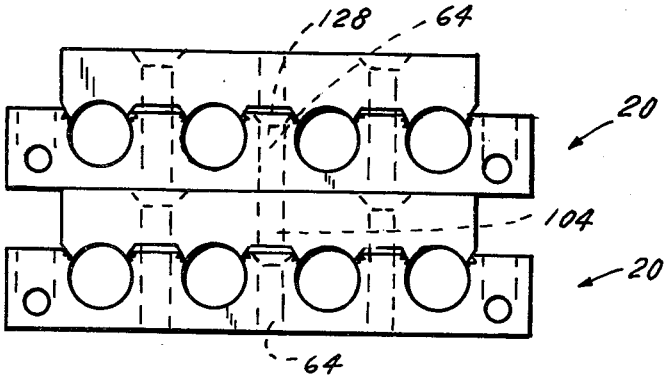

FIG. 6
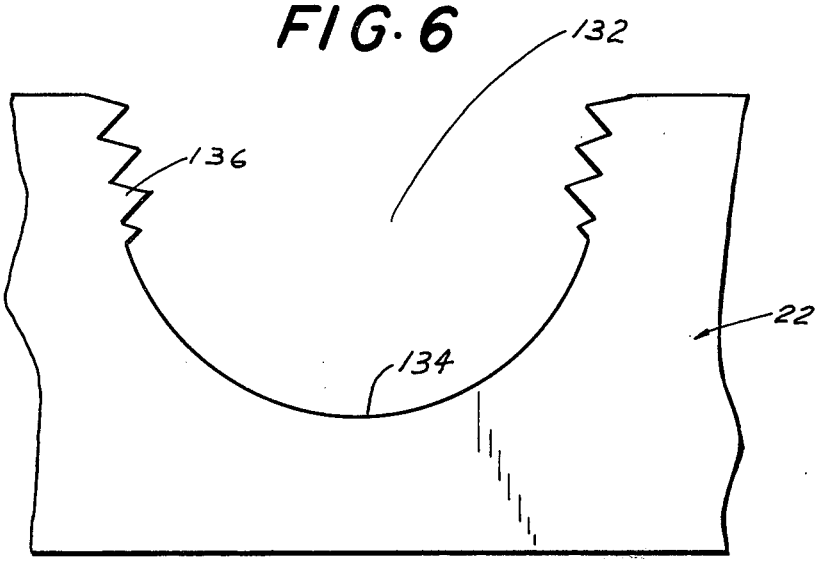
FIG. 7
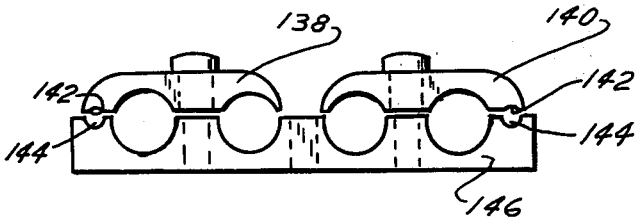
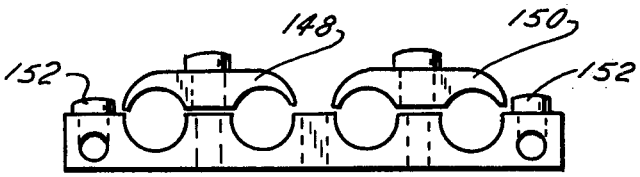
FIG. 8
FIG. 9
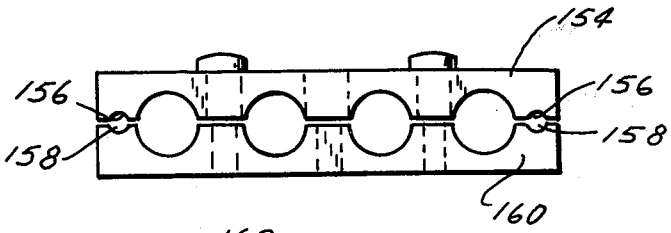
FIG. 10
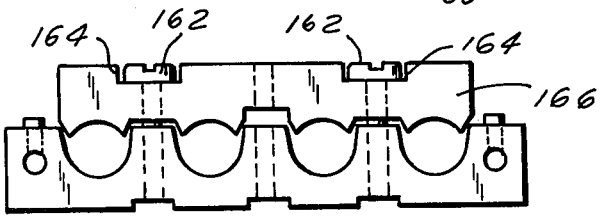

GROUNDING CONNECTOR

BACKGROUND OF THE INVENTION

In handling electrical cables such as telephone cables, recent changes particularly technical changes have resulted in the need for additional elements of mounting and handling equipment for the cables. For example, a revision contained in the 1978 National Electrical Safety Code (ANSI C2) precludes the use of unprotected PVC jacketed telephone cable in commercial/industrial buildings. Thus, as an alternate to the use of conduit to enclose the existing cables, a new aluminum sheathed cable, which satisfies the new requirements, has been developed.

Accordingly, a need has arisen for a connector for these cables to provide a means for grounding the aluminum sheath in the vicinity of the terminal board to protect personnel in the event that the telephone cable contacts an electrical cable and becomes energized.

SUMMARY OF THE INVENTION

With the above background in mind, it is among the primary objectives of the present invention to provide a grounding connector for the new type aluminum sheathed telephone cable. The connector of the present invention is adapted to be formed of an extruded aluminum alloy and is designed to accommodate, for example, 4 aluminum sheathed, 25 pair telephone cables with provision for attaching a #6 or smaller solid copper ground wire at each end of the connector. The connector is designed to consist of two extruded members, a base plate and a pressure pad and appropriate hardware is provided to clamp the two components for securing and bonding a number of cables, such as from one to four cables. The connectors are designed so that they may be used side by side or in stacked position to accommodate more cables.

It is an objective to provide a base plate with appropriate grooves to form cable positions therein which are designed so that a one piece keeper or pad can be temporarily removed to add or remove a cable while retaining a good bond on other existing cables. In one preferred form, each cable groove or receptacle in the base plate is formed with a parabolic-V groove design with longitudinal teeth, of a saw tooth configuration, on the peripheral edge portion of the surface of the cable groove or recess.

The saw tooth design permits the cable to be forced down into the groove under the pressure exerted by tightening the pressure pad. The aluminum sheath is pliable to pressure and consequently, will lend itself to force fit through the abrading serrations, and full contact seating within the parabolic-V grooved cable position. The parabolic-V groove design provides an initial line contact, causing the pliable aluminum sheathed cable to "bell-out" in the cable groove below the teeth, and establish full contact seating. The teeth serve to retain the cable during temporary removal of the one-piece pressure pad for the purpose of installing or removing a cable. The bond on existing cables is thus maintained during this temporary removal of the pressure pad.

Furthermore, the saw tooth design will abrade the aluminum sheathing, removing any oxides or anodizing and enhancing the quality of the bond/ground connection. Additionally, the base plate is designed so that it can be conveniently secured to a backboard such as by the use of a conventional #8 wood screw.

Also, it is an objective to provide a connector with means on the base plated pressure pad for providing for independently installing a #6 or smaller copper ground wire in each end of the base plate to be secured by set screws, or held by the pressure pad.

The connectors are designed so that they can be mounted one above the other in stacked fashion and secured to one another by appropriate fasteners such as screws and the like.

Furthermore, the pressure pad can be designed so that it is sized to accommodate and mate with a four groove base plate or, if desired, the pressure pad can be designed to cooperate with two side by side grooves with two pressure pads being used for a four grooved base plate.

Other alternatives in design can incorporate different configurations and/or multiplicities of scraping teeth, or replacement of the scraping teeth with a boss or rib, or simply allow for sufficient reverse draft on the upper sides of the cable groove to provide the forced fit cable retention feature.

Accordingly, in summary, the grounding connector is provided which includes a base plate having a plurality of grooves for aluminum clad or other similar metal clad telephone cables and a pressure pad adapted to be removably coupled with the base plate to facilitate retention of the metal clad telephone cables in the grooves. Means is provided on the connector for connection to ground. Each groove has a configuration for assisting in retaining the metal clad telephone cables therein and grounding the cables.

With the above objectives among others in mind, reference is made to the attached drawing.

BRIEF DESCRIPTION OF THE DRAWING

In the Drawing:

FIG. 1 is an exploded view of a grounding connector of the invention with fragmentary portions of four metal clad telephone cables depicted therewith;

FIG. 2 is a sectional view thereof in assembled condition retaining and grounding four cables;

FIG. 3 is an elevation and plan view of two grounding connectors of the invention retaining metal clad telephone cables and stacked one above the other;

FIG. 6 is an enlarged fragmentary view of an alternative grounding connector of the invention showing a different configuration groove;

FIG. 7 is an elevation view of a second alternative grounding connector of the invention;

FIG. 8 is an elevation view of a third alternative grounding connector of the invention;

FIG. 9 is an elevation view of a fourth alternative grounding connector of the invention; and FIG. 10 is an elevation view of a fifth alternative grounding connector of the invention.

DETAILED DESCRIPTION

Figure 4:
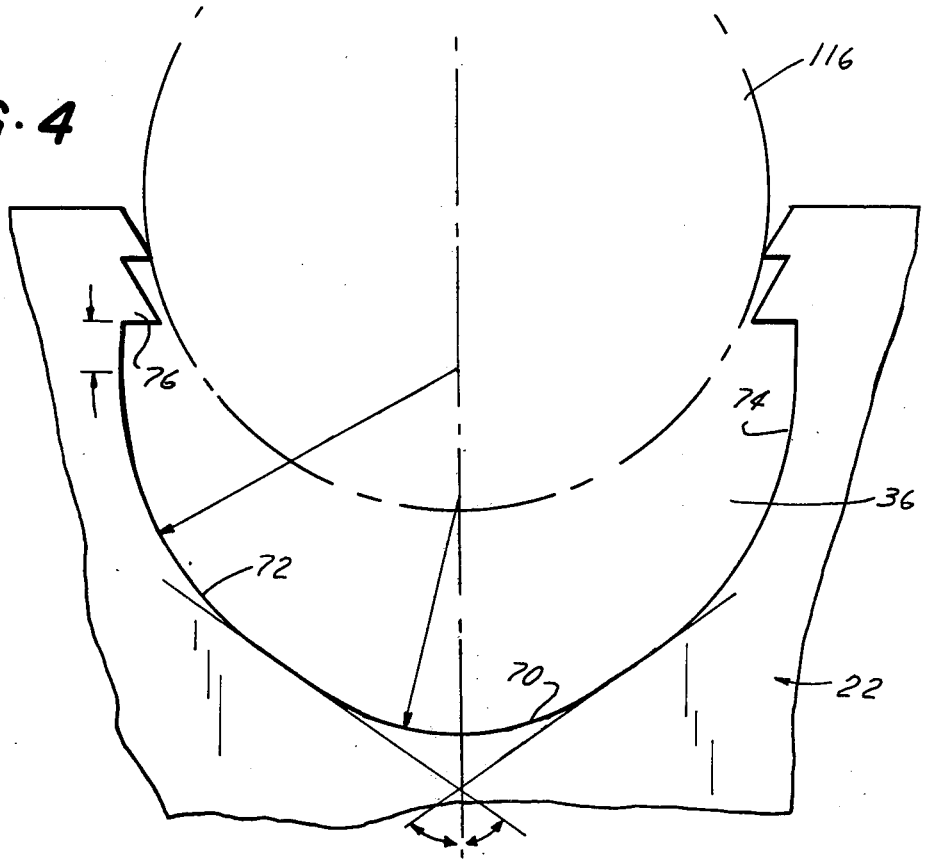
FIG. 4 is an enlarged fragmentary view of a grounding connector of the invention showing a groove and a metal clad telephone cable partially inserted therein.

Grounding connector 20 of the invention is depicted in exploded form in FIG. 1. Basically, it includes a base plate 22 and a pressure pad 24. These two elements can be formed of a conventional conductive material such as extruded aluminum.

The base plate is substantially rectangular in configuration with a flat rear surface 26, a flat upper surface 28 a flat undersurface 30 and flat end surfaces 32 and 34. The forward face is provided with four side by side spaced recesses or grooves 36, 38, 40 and 42. Adjacent grooves 36 and 38 are separated by flat forward surface 44, adjacent grooves 38 and 40 are separated by flat forward surface 46 and, similarly, adjacent grooves 40 and 42 are separated by flat forward surface 48. The remainder of the forward face of base plate 22 includes two end forward faces 50 and 52.

Upper face 28 is formed with a pair of apertures 54 and 56. Forward face 50 has a threaded aperture 58 therein and forward face portion 52 has a similar threaded aperture 68 therein. Forward face portion 44 has a threaded aperture 62, forward face 46 has an aperture 64 and forward face portion 48 has a threaded aperture 66.

Figure 5:
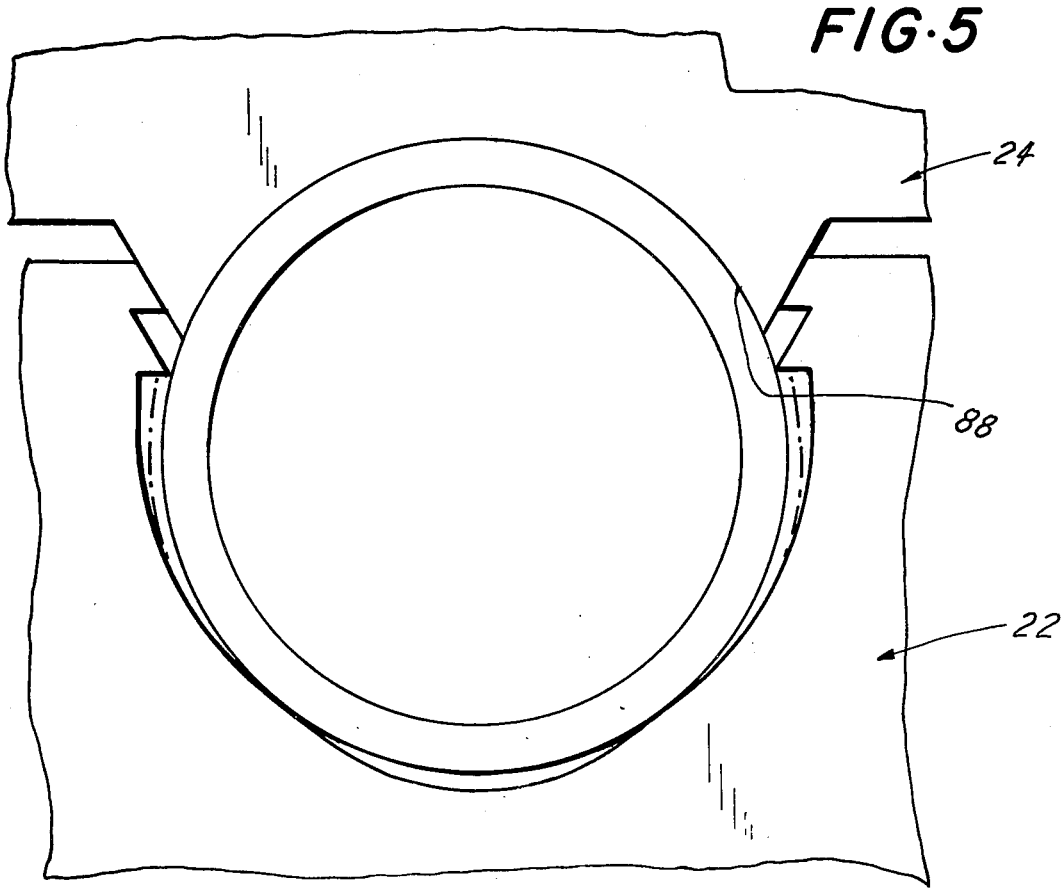
FIG. 5 is an enlarged fragmentary portion of the grounding connector of the invention showing a cable fully mounted in a groove of the connector and held in position by the pressure pad.

The configuration of grooves 36, 38, 40 and 42 are identical and that configuration is best seen in FIGS. 4 and 5 of the drawings. Each groove has a parabolic-V shaped surface with the interior portion 70 having a different radius of curvature than the two adjacent side portions 72 and 74. Each side portion 72 and 74 terminates in a peripheral edge portion formed with a pair of longitudinal teeth 76 extending inward around the peripheral edge of the groove to provide a saw tooth configuration. The inner portion 70 of the groove has a smaller radius of curvature than the two adjacent side portions to achieve the desired parabolic-V groove configuration.

Returning to FIG. 1, the pressure pad is substantially rectangular in configuration and includes a flat rear surface 78, a flat upper surface 80, a flat undersurface 82 and flat end surfaces 84 and 86. The forward face is provided with four spaced arcuate recesses 88, 90, 92 and 94 in side by side relationship and adapted to be aligned with grooves 36, 38, 40 and 42 respectively of the base plate. Similarly, flat forward face portion 96 is in position for alignment with portion 44 of the base plate, flat portion 98 is in position for alignment with portion 46 and portion 100 of the pressure pad is in position for alignment with portion 48 of the base plate. Similarly, through aperture 102 is in position for alignment with threaded aperture 62, through threaded aperture 104 is in position for alignment with aperture 64 and through aperture 106 of the pressure pad is in alignment with threaded aperture 66 of the base plate when the pressure pad is coupled with the base plate.

Opening 58 of the base plate contains a threaded set screw 112 and similarly threaded aperture 68 of the base plate contains a threaded set screw 114.

To facilitate the coupling of pressure pad 24 with base plate 22, a pair of machine screws 108 and 110 are provided. Machine screw 108 extends into aligned apertures 102 and 62 and machine screw 110 extends into aligned apertures 106 and 66.

In the depicted connector, four cables such as AL-Sheath telephone cables can be grounded by grounding connector 20 with cable 116 retained in groove 36, cable 118 in groove 38, cable 120 in groove 40 and cable 122 in groove 42.

In operation, the cables are placed into their respective grooves as depicted in FIGS. 4 and 5 which shows cable 116 being inserted into recess 36 of base plate 22. The cable is forced past the teeth 76 until it fully seats in the recess. As it is forced in, the teeth 76 abrade the aluminum sheathing of the cable and remove any oxide or anodizing and enhance the quality of the bond/-ground connection. The cable is then fully forced into the groove by coupling pressure plate 24 with base plate 22. The pressure plate is positioned so that it is properly aligned with the base plate in which case arcuate recess 88 engages with the adjacent surface of cable 116 in alignment with groove 36 and forces the cable to fully seat within the groove. This is accommodated by passage and threaded interengagement of machine screws 108 and 110 through the aligned respective apertures in the pressure pad and base plate to thereby tightly couple the pressure pad to the base plate and fully seat the cable. The teeth 76 permit the cable to be forced out into the groove 36 under the pressure exerted by tightening pressure pad 24 as machine screws 108 and 110 are fully threaded into the base plate. The aluminum sheath of the cable is pliable to pressure and consequently, will lend itself to be forced fit through the abrading serrations 76. Full contact seating is accomplished in the parabolic-V grooved cable position. The parabolic-V groove desing provides an initial line contact, causing the pliable aluminum sheathed cable to "bell-out" in groove 36 below the teeth 76 and establish full contact seating. The teeth 76 then serve to retain cable 116 during temporary removal of pressure pad 24 for the purpose of installing or removing a further cable. The bond on existing cable is thus maintained during this temporary removal of pressure pad 24.

To accomplish the complete ground by means of grounding connector 20, a ground wire 124 is passed through either aperture 54 and retained in position by means of set screw 112 or aperture 56 and retained in position by means of set screw 114. The ground wire is a common type of grounding element such as #6 or smaller solid copper ground wire.

Connector 20 can be mounted in a conventional fashion to a supporting surface such as a background by using a conventional fastener such as a #8 pan head tapping screw.

Various alternative arrangements can also be employed such as stacking connectors 20 as shown in FIG. 3 where two connectors are stacked one above the other. For this purpose, a conventional machine screw 128 can be passed through the central aperture 64 of the base plate of the upper connector 20 and then into aligned threaded openings 104 in the lower connector 20 for threaded interengagement therewith. Numerous connectors can be interengaged in a similar manner for grounding purposes in stacked fashion or they can be arranged side by side with appropriate screws or similar connectors used for the interconnection therebetween.

Alternative configurations for the grooves can also be provided such as that shown in FIG. 6. In that Figure, groove 132 is provided with a base surface 134 with a constant radius of curvature and a slightly different configuration and number of teeth 136 adjacent the peripheral edge. Attachment is accomplished in the same manner as in connection with the embodiment of FIGS. 1 and 2.

Other modifications are shown in FIGS. 7-9. In FIG. 7, a separate pair of pressure pads 138 and 140 are used for the connector in place of the single pressure pad 24 of the embodiment of FIGS. 1 and 2. Also, the two pressure pads are provided with a pair of peripheral recesses 142 which mate with corresponding recesses 144 in base plate 146 to hold the copper ground wires. This enables the pressure pads to accomplish the function of the set screws of the embodiment of FIGS. 1 and 2.

In FIG. 8, two pressure pads 148 and 150 are employed again for coupling with the four grooves of the base plate, however, the pressure pads in this instant do not double as means for holding the ground wires. The ground wires are retained by seprate screw arrangements 152 in a similar manner to the set screw arrangements of the embodiment of FIGS. 1 and 2.

A further depicted embodiment is shown in FIG. 9 where a single pressure pad 154 mates with the four grooves in the base plate as in the embodiment of FIGS. 1 and 2, but additionally, the pressure pad is provided with a pair of peripheral recesses 156 which mate with accommodating recesses 158 in the base plate 160 to retain the grounding wires. Thus, as with the embodiment of FIG. 7, the pressure pad acts in holding the ground wires in position in place of a set screw arrangement.

FIG. 10 shows another alternative form in which "pan head" machine screws 162 are used for the fasteners. Accommodating recesses 164 in pressure pad 166 are provided for the respective screws 162. Otherwise, the embodiment of FIG. 10 operates as the previously discussed forms of the invention.

Naturally other alternative designs can incorporate different configurations and/or multiplicity for the teeth in the grooves or even replacement of the scraping teeth with a boss or rib. In fact, the configuration of the groove can be such that there is sufficient reverse draft on the upper side of the groove to provide for a forced fit cable retention feature.

With the connector of the present invention, the low resistance ground connection optimizes the effectiveness of protective circuit breaking equipment, providing safety to personnel in the event of accidental contact between the grounded aluminum sheathed cable and an exposed electrical conductor.

The provision of slotted head machine and set screws, compatible with hardware currently used by telephone operating equipment crews, assures easy installation without the need of special tools when the connector is used in the telephone cable environment.

It should also be kept in mind that the cable retaining feature of the present connector is designed to enable and install it to remove the one-piece pressure pad to add or remove a cable, while maintaining electrical continuity. Under these circumstances, the resistance across the connection remains significantly lower than the resistance of an equivalent length of #12 solid copper conductor, which is more than adequate to operate a breaker and prevent any hazardous potential rise occurring to the cable.

The ground connection provided by the connector of the present invention is more than adequate to insure activation of protective circuit breaking equipment.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A grounding connector comprising: a base plate having a plurality of grooves for metal clad telephone cables, a pressure pad adapted to be removably coupled with the base plate to facilitate retention of the metal clad telephone cables in the grooves, means on the connector for connecting to ground, and each groove having a configuration including an inwardly extending interferring surface on the surfaces forming each groove in position to engage and assist in retaining the metal clad telephone cables therein and grounding the cables.

2. The invention in accordance with claim 1 wherein the connector is formed of electrically conductive material.

3. The invention in accordance with claim 1 wherein each groove in the base is an arcuate recess having a parabolic-V groove configuration.

4. A grounding connector comprising; a base plate having a plurality of grooves for metal clad telephone cables, a pressure pad adapted to be removably coupled with the base plate to facilitate retention of the metal clad telephone cables in the grooves, means on the connector for connecting to ground, and each groove having a configuraton for assisting in retaining the metal clad telephone cables therein and grounding the cables, and each groove is an arcuate recess formed in the base plate with a plurality of teeth extending inward from the peripheral edge portion of the groove to form a saw tooth configuration.

5. A grounding connector comprising: a base plate having a plurality of grooves for metal clad telephone cables, a pressure pad adapted to be removably coupled with the base plate to facilitate retention of the metal clad telephone cables in the grooves, means on the connector for connecting to ground, and each groove having a configuration for assisting in retaining the metal clad telephone cables therein and grounding the cables, each groove is formed of an arcuate configuration with a plurality of teeth extending inward from the peripheral edge portion thereof, the configuration of the recess and the teeth cooperating to assist in retaining at least one metal clad telephone cable in the groove and ground the cable.

6. The invention in accordance with claim 5 wherein there are four grooves in side by side position on the base plate and a projection on the pressure pad adapted to cooperate with each groove in retaining a cable in the connector when the pressure pad is coupled with the base plate.

7. The invention in accordance with claim 6 wherein the pressure pad is coupled to the base plate by use of an arrangement of threaded fasteners passed through cooperating threaded holes in the pressure pad and the base plate.

8. The invention in accordance with claim 1 wherein the connector is grounded by means of at least one threaded aperture and set screw arrangement adapted to receive and hold a ground wire to ground the connector and cables mounted therein.

9. The invention in accordance with claim 1 wherein means is provided for mounting at least two connectors on top of one another and securing adjacent connectors to one another to form a plurality of the grounding connectors for metal clad telephone cables.

10. The invention in accordance with claim 1 wherein there are two pressure pads and four grooves on the base plate in side by side relationship, with each pressure pad adapted to be coupled with a pair of adjacent grooves.

11. The invention in accordance with claim 1 wherein the pressure pad is adapted to be removably coupled with the base plate and to cooperate with the base plate in forming the means for connection to ground.

12. The invention in accordance with claim 1 wherein the connector is formed of an extruded aluminum alloy material and is adapted for grounding aluminum sheath telephone cables with the use of a solid copper ground wire.

* * * * *